US006146702A

United States Patent [19]

Zitko

[11] Patent Number: 6,146,702

[45] **Date of Patent: *Nov. 14, 2000**

[54] ELECTROLESS NICKEL COBALT PHOSPHOROUS COMPOSITION AND PLATING PROCESS

[75] Inventor: Mark W. Zitko, Meriden, Conn.

[73] Assignee: Enthone-OMI, Inc., West Haven, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/963,999

[22] Filed: Nov. 4, 1997

Related U.S. Application Data

[63] Continuation of application No. 08/579,289, Dec. 27, 1995, abandoned, which is a continuation-in-part of application No. 08/465,681, Jun. 6, 1995, abandoned.

[51] Int. Cl.[7] ..... B05D 1/18; B05D 3/02

[52] U.S. Cl. ..... 427/376.6; 427/305; 427/376.7; 427/376.8; 427/437; 427/438; 427/443.1

[58] Field of Search ..... 427/376.7, 376.8, 427/437, 438, 443.1, 443.2, 305, 376.6

[56] References Cited

U.S. PATENT DOCUMENTS

| | | | |
|---|---|---|---|
| 3,202,529 | 8/1965 | Dunlap, Jr. et al. | 427/438 |
| 3,274,079 | 9/1966 | Passal | 204/43 |
| 3,432,338 | 3/1969 | Sickles | 427/438 |
| 3,666,529 | 5/1972 | Wright et al. | 117/50 |
| 3,753,667 | 8/1973 | Metzger et al. | 29/195 |
| 4,017,265 | 4/1977 | Tayler | 428/675 |
| 4,072,781 | 2/1978 | Shirahata et al. | 428/336 |
| 4,139,942 | 2/1979 | Sastri et al. | 30/346.54 |
| 4,150,172 | 4/1979 | Kolk, Jr. | 427/129 |
| 4,160,049 | 7/1979 | Narcus | 427/404 |
| 4,184,941 | 1/1980 | Carlin | 204/292 |
| 4,268,369 | 5/1981 | Barlow et al. | 204/192 D |
| 4,482,596 | 11/1984 | Gulla et al. | 428/131 |
| 4,486,233 | 12/1984 | Josso et al. | 106/1.22 |
| 4,567,066 | 1/1986 | Schultz et al. | 427/305 |
| 4,692,349 | 9/1987 | Georgiou et al. | 437/230 |
| 4,718,990 | 1/1988 | Hashimoto et al. | 204/1 |
| 4,735,853 | 4/1988 | Okudaira et al. | 428/336 |
| 4,735,863 | 4/1988 | Okudaira et al. | 428/336 |
| 4,954,370 | 9/1990 | Mahmoud | 327/438 |
| 4,983,428 | 1/1991 | Hodgens, II | 427/443.1 |
| 5,074,957 | 12/1991 | Horiuti et al. | 156/651 |
| 5,308,660 | 5/1994 | Huval | 427/443.1 |
| 5,478,462 | 12/1995 | Walsh | 205/169 |
| 5,578,187 | 11/1996 | Zitko et al. | 205/191 |

FOREIGN PATENT DOCUMENTS

| | | | |
|---|---|---|---|
| 0 289 838 | 11/1988 | European Pat. Off. . | |
| 289838 | 11/1988 | European Pat. Off. . | |
| 2 272 959 | 1/1994 | United Kingdom | F16J 9/26 |

OTHER PUBLICATIONS

Lawless et al., "Electroless Plating Variables and Coercive Force of Nickel–Cobalt–Phosphorus Films", Plating, pp. 709–713 Jun. 1967.

Magnet Properties of Electroless Cobalt Based Alloys, Fred Pearlstein and Robert F. Weightman, Plating, Jun. 1967, pp. 714–716.

Electroless Plating Variables and Coercive Force of Nickel–Cobalt–Phosphorus Films, G.W. Lawless and R.D. Fisher, Plating, Jun. 1967, pp. 709–713.

*Primary Examiner*—Shrive Beck
*Assistant Examiner*—Michael Barr
*Attorney, Agent, or Firm*—DeLio & Peterson, LLC; Richard P. Mueller

[57] ABSTRACT

A process is provided for enhancing the wear resistance of aluminum and other materials by depositing on the substrate a nickel, cobalt, phosphorous alloy coating using an electroless plating bath to provide a plated alloy having a cobalt content of at least about 20% by weight and a % Co/% P weight ratio of at least about 5. A preferred bath contains an effective amount of glycolic acid or salts thereof. The alloy deposit is preferably plated over a zincated aluminum substrate.

14 Claims, No Drawings

ELECTROLESS NICKEL COBALT PHOSPHOROUS COMPOSITION AND PLATING PROCESS

This is a continuation of copending application(s) Ser. No. 08/579,289 filed on Dec. 27, 1995 now abandoned, which is a continuation-in-part of U.S. Ser. No. 08/465,681, filed Jun. 6, 1995, now abandoned.

BACKGROUND OF THE INVENTION

1. Field of the Invention

This invention relates generally to the electroless metal plating of a substrate to provide a wear resistant coating and, in particular, to the use of a nickel, cobalt, phosphorous electroless plating bath composition to plate aluminum articles with a specially correlated nickel, cobalt, phosphorous alloy wear resistant coating.

2. Description of Related Art

There are many materials of construction and each has properties which make it useful for certain applications. A property needed in many applications is wear resistance to provide a long operating life for the part made from the material and wear resistance may be defined as the ability of a material to withstand erosion or wearing away when the material is in moving contact with another material. Wear resistance is an important property for materials employed for such uses as tools and household appliances to industrial products like machine parts, pumps and gears.

The material of construction used for an application is normally chosen for properties such as strength, cost, weight and the ability to be formed into the desired product. In many applications however, this material does not have the required wear resistance and cannot be used and this problem has been researched extensively and wear resistant coatings have been developed to extend the usefulness of materials. In automobiles, for example, lightweight metals such as aluminum are extensively used in the manufacturing process to reduce the weight of the car to increase its fuel efficiency and meet environmental regulations. Aluminum, however, does not have the wear resistance of the heavier steel and would wear out faster and need to be replaced more frequently. This is not economically practical and coatings have been developed to increase the wear resistance of aluminum for use in automobiles and other applications.

A coating for aluminum now used in automobiles is a nickel-Teflon deposit applied from an electroless nickel-Teflon metal plating bath. These coatings are functional alternatives to the use of heavier weight materials of construction and hard chromium deposits which are environmentally undesirable. Unfortunately, the demands of industry are continually increasing and more severe operating conditions, cost factors and environmental concerns dictate the need for materials, especially lightweight materials, which are more wear resistant and preferably more cost effective than existing materials and/or coatings now used.

The following discussion for convenience will be directed to the plating of aluminum and it will be understood to those skilled in the art, that similar properties are needed for other materials in other applications requiring wear resistant coatings. In general, new requirements to be met for wear resistant coatings on aluminum include a low heat treatment temperature preferably about 200° C. or below for increasing the hardness and wear resistance of the plated coating, a hardness after heat treatment above approximately 600 and preferably 700–800 $HV_{10}$ and the passing of a standard wear test such as the Taber Wear Index (TWI) which is calculated using a Taber Abraser. The Taber Abraser is an instrument designed to evaluate the resistance of surfaces to rubbing abrasion. The characteristic rub-wear action of the Abraser is produced by the contact of a test sample, turning on a vertical axis, against the sliding rotation of two abrading wheels. The wheels are driven by the sample in opposite directions about a horizontal axis displaced tangentially from the axis of the sample with one abrading wheel rubbing the specimen outward toward the periphery and the other, inward toward the center. The resulting abrasion marks form a pattern of crossed arcs over an area of approximately 30 square centimeters. Test results are expressed as a wear factor or numerical abrasion index of the test specimen and one method of evaluation is the TWI (rate of wear) based on the loss in weight in milligrams (mgs.) per thousand cycles of abrasion under a specific set of conditiions. The lower the TWI, the better the abrasion resistance quality of the material. Using a CS-10 Calibrase wheel under a load of 1 kilogram for 5000 cycles, TWI's less than 20 and preferably less than 10 are desired for aluminum and other materials to meet the necessary wear resistance requirements.

U.K. Patent No. 2272959 provides hard wearing surfaces for aluminum piston grooves having a hardness in the range of 300 to 750 HV by applying a coating of cobalt by electroless plating. The coating may contain 1–10% by weight phosphorous and may be heat treated after coating at a temperature between 150° C. and 500° C. for at least 30 minutes. The deposition of a wear resistant nickel-cobalt-phosphorous alloy is not disclosed. U.S. Pat. No. 4,983,428 provides wear resistant nickel-boron coatings on turbine engine parts using an electroless nickel plating bath containing ethylenethiourea.

Nickel-cobalt-phosphorous electroless metal plating baths are known to be used to form high coercive force films on substrates used for magnetic storage devices. "*Electroless Plating Variables and Coercive Force of Nickel-Cobalt-Phosphorous Films*" by G. W. Lawless and R. D. Fisher, Plating, June 1967, pages 709–713 shows the effect of solution composition variables such as Ni/Co ratio on the coercivity of Ni—Co—P films. Similarly, "*Magnetic Properties of Electroless Cobalt Based Alloys*" by F. Pearlstein and R. F. Weightman, Plating, June 1967, pages 714–716 shows the effect on magnetic properties of the coating by adding nickel sulfate to an electroless cobalt solution. U.S. Pat. No. 4,150,172 discloses an electroless bath containing cobalt ions, citrate ions, hypophosphite ions, phosphate ions and, if desired, nickel ions, for use to form magnetic recording film.

Bearing in mind the problems and deficiencies of the prior art, it is therefore an object of the present invention to enhance the wear resistance of a substrate by applying to the surface of the substrate from an electroless metal plating bath a specially defined nickel, cobalt, phosphorous alloy coating.

It is another object of the present invention to provide an aqueous composition for electrolessly plating a substrate with an enhanced wear resistant nickel, cobalt, phosphorous alloy coating.

A further object of the invention is to provide a process for plating a substrate with an electrolessly deposited nickel, cobalt, phosphorous alloy to enhance the wear resistance of the substrate.

It is yet another object of the invention to provide articles, especially aluminum articles, having a wear resistant coating of a specially defined electroless nickel, cobalt, phosphorous alloy.

Still other objects and advantages of the invention will in part be obvious and will in part be apparent from the specification.

SUMMARY OF THE INVENTION

In one aspect of the invention an aqueous composition is provided for plating a substrate with an enhanced wear resistant nickel, cobalt, phosphorus alloy comprising: nickel ions in an amount of about 0.1 to 100 g/l; cobalt ions in an amount of about 0.1 to 100 g/l; a phosphorus containing reducing agent in an amount sufficient to reduce the nickel and cobalt ions; an effective amount of a complexing agent; an effective amount of a buffering agent; and an amount of a pH adjusting material to provide an initial pH of the composition which is about 6.5 to 11 or higher, preferably 7.5 to 9 e.g., 8, with the proviso that the plated alloy contain greater than about 20% cobalt by weight and the % Co/% P weight ratio be greater than about 5. A preferred bath contains glycolic acid or salts thereof as a complexing agent either as a total or partial substitute for other complexing agents.

In another aspect of the invention a process is provided for plating a substrate with a nickel, cobalt, phosphorous alloy to enhance the wear resistance of the substrate with the proviso that the plated alloy contain greater than about 20% by weight cobalt and the % Co/% P be greater than about 5, comprising: providing a substrate having a catalytic surface; depositing a nickel, cobalt, phosphorous coating on the substrate by an electroless plating process using an electroless plating composition comprising: nickel ions in an amount of about 0.1 to 100 g/l; cobalt ions in an amount of about 0.1 to 100 g/l; a phosphorus containing reducing agent in an amount sufficient to reduce the nickel and cobalt ions; an effective amount of a complexing agent; an effective amount of a buffering agent; and an amount of a pH adjusting material to provide a pH of the composition which is about 6.5 to 11 or higher, preferably about 7.5 to 9, e.g., 8. Glycolic acid or salts thereof are preferred to be used partially as the complexing system and may be used totally as the complexing system.

In yet another aspect of the invention an article, preferably an aluminum article, is provided having a wear resistant coating which coating has a $HV_{10}$ hardness above about 600 when heat treated at 200° C. for at least 1 hour and a Taber Wear Index less than 20, preferably less than 10, when using a CS-10 Calibrase wheel under a load of 1 kilogram for 5000 cycles comprising a substrate having a catalytic surface plated with an autocatalytic electroless alloy of nickel, cobalt and phosphorus wherein, in percent by weight, the cobalt is about 20 to 70, preferably about 30 to 50, the phosphorous is about 2 to 9, preferably about 3 to 5 and the balance essentially nickel and the % Co/% P weight ratio is greater than 5, preferably greater than 10 and most preferably greater than 15 or 20. A preferred embodiment for the substrate is aluminum and it is highly preferred that the substrate contain a protective catalytic surface such as a zincate coating or a zincate coating overlaid with a strike coating of electroless nickel or other catalytic material.

DESCRIPTION OF THE PREFERRED EMBODIMENT(S)

Any substrate may be coated using the composition and process of the present invention to increase its wear resistance with the proviso that the substrate be autocatalytic to electroless nickel/cobalt/phosphorous plating and/or made autocatalytic to electroless nickel/cobalt/phosphorous plating. Metals such as titanium, steel, nickel and copper may be directly plated. Other non-catalytic metals such as magnesium and aluminum may be plated and are usually coated by first subjecting the metal to a flash or strike coating such as zincate type immersion plate or other such catalyzing process. Materials such as graphite and plastics may also be provided with a wear resistant coating provided the plastic is catalyzed using known techniques such as treating the plastic with a noble metal catalyst. While any material can be used, the following description will be specifically directed for convenience to aluminum substrates because of their wide use in industry.

The aluminum to be electrolessly plated is preferably first pretreated with a barrier coating such as zinc or other metal such as tin using known techniques and procedures. In a preferred process using a zincate process, the zincated aluminum is strike coated with an electroless nickel or other catalytic coating. The coated aluminum substrate may then be electrolessly plated with the nickel, cobalt, phosphorous alloy of the invention. Any electroless nickel plating bath or other catalytic metal plating bath can be used to apply the strike coating on the zincated aluminum. Compositions for depositing electroless nickel on aluminum and a preferred strike procedure are described in U.S. Pat. No. 4,567,066 which patent is hereby incorporated by reference.

In general, the electroless nickel, cobalt, phosphorous plating of the substrate is performed using an aqueous bath which has been specially controlled to provide the enhanced wear resistant alloys of the invention. The baths contain 1) a source of the nickel and cobalt ions, 2) a phosphorous containing reducing agent such as a hypophosphite, 3) a pH adjuster to provide the required pH and 4) a complexing agent for metal ions sufficient to prevent their precipitation and preferably a bath effective amount of glycolic acid or salts thereof. An effective amount of a buffering agent is also generally used to maintain the desired pH of the plating solution.

The nickel ion may be provided by the use of any soluble salt such as nickel sulfate, nickel chloride, nickel sulfamate and mixtures thereof. The concentration of the nickel ions in solution may vary widely and is about 0.1 to 100 g/l, preferably about 2 to 20 g/l, most preferably about 2 to 10 g/l, e.g. 2 to 6. The cobalt ion may likewise be provided by the use of any soluble salt such as cobalt sulfate, cobalt chloride, cobalt sulfamate and mixtures thereof. The concentration of the cobalt in solution may also vary widely and is about 0.1 to 100 g/l, preferably about 2 to 20 g/l, most preferably 2 to 10 e.g., 2 to 6 g/l.

The phosphorous containing reducing agent is usually the hypophosphite ion supplied to the bath by any suitable source such as sodium, potassium, ammonium and nickel hypophosphite. Other phosphorous containing reducing agents may be used but the hypophosphite ion is most preferred. The concentration of the reducing agent is generally in excess of the amount sufficient to reduce the nickel and cobalt in the bath and the hypophosphite ion is typically about 5 to 100 g/l, preferably 5 to 50 g/l.

The pH of the plating bath is about 6.5 to 11 or higher and the pH adjuster may be selected from a wide range of materials such as ammonium hydroxide, sodium hydroxide and the like. The pH of the bath is generally about 6.5 to 11 with a range of 7.5 to 9, e.g., 8 being preferred. It is preferred that the electroless nickel, cobalt, phosphorous plating bath contain a buffering agent such as ammonium sulfate to help maintain the desired pH of the bath. The buffering agent is generally employed in an amount of 20 to 100 g/l and materials such as ammonium sulfate may be employed.

The complexing agent may be selected from a wide variety of materials containing anions such as acetate, citrate, tartrate, lactate and malate (from carboxylic acids) pyrophosphate and the like, with mixtures thereof being suitable. Ranges for the complexing agent, based on the anion, may vary widely, for example, from about 1 to 300 g/l, preferably from about 20 to 150 g/l, e.g., 20 to 80. Other ingredients known in the art for use in such plating bath include; bath stabilizers, rate promoters, brighteners, etc. It is preferred because of its demonstrated effectiveness to use an iodate material and thiocyanate material in combination in the bath as the stabilizer and potassium iodate and sodium thiocyanate have been found to be particularly effective. The amounts of stabilizer vary widely and are generally for the iodate about 5 to 15 mg/l and for the thiocyanate about 0.75 to 1.1 mg/l. It is also preferred to use a surfactant in the bath and an anionic surfactant is preferred because of its demonstrated effectiveness.

It is a preferred feature of the invention that the bath contain an effective bath enhancing amount of glycolic acid or salts thereof. The amount of glycolic acid or salt is generally about 5 to 50 g/l preferably about 10 to 30 g/l. Glycolic acid may also be used completely as the bath complexing agent in which event the amount used is as above. Glycolic acid has been found to increase the plating rate of the bath and to provide an operating bath capable of providing the desired nickel, cobalt, phosphorous alloy wear resistant coating and has a stabilizing effect on the bath against decomposition. It is also theorized that the glycolic acid aids in the deposit of the alloy and provides an enhanced wear resistant coating.

A suitable bath may be formed by dissolving the ingredients in water and adjusting the pH to the desired range.

The part to be plated may be plated by immersing the part in the bath until the desired thickness is obtained. An immersion time of about 30 to 120 minutes, e.g., 90 minutes, usually provides the desired coating depending on bath parameters. A temperature range of the bath may be from ambient to boiling with a range of about 60 to 90° C. being preferred, e.g., 70 to 85° C. The plating thickness may vary widely and is usually about 5 to 50 microns or more, usually 10 to 20 microns.

It will be appreciated by those skilled in the art that the rate of plating and alloy composition of the plating is influenced by many factors including 1) pH of the plating solution, 2) concentration of reductant, 3) temperature of the plating bath, 4) concentration of soluble nickel and soluble cobalt, and 5) presence of wetting agents and/or agitation, and that the above parameters are provided to give general guidance for practicing the invention.

The plated parts are preferably heat treated to increase the hardness and wear resistance of the plated part. It is an important feature of the invention that the plated substrates can be effectively heat treated at low temperatures below about 250° C. and preferably below about 200° C., e.g., 170 to 200° C. Higher heat treatment temperatures may be employed but are unacceptable for many applications. The heat treatment times may vary and will usually be about 1 to 6 hours, typically 2 to 5 hours.

Examples illustrating various plating baths and conditions under which the process may be carried out follows.

EXAMPLE 1

An electroless Ni—Co—P plating bath was prepared having the following composition:

| COMPONENT | CONCENTRATION |
|---|---|
| Nickel Sulfate Hexahydrate | 15.8 g/L |
| Cobalt Sulfate Heptahydrate | 28.1 g/L |
| Sodium Citrate | 50 g/l |
| Sodium Glycolate | 20 g/L |
| Ammonium Sulfate | 40 g/L |
| Sodium Hypophosphite | 25 g/L |
| Sodium Thiocyanate | 0.9 mg/L |
| Potassium Iodate | 12.2 mg/L |
| Anionic Surfactant | 20 mg/L |

Aluminum specimens were first degreased using an alkaline surfactant at 60° C. for 5 minutes. An acidic etch using a phosphoric acid-sulfuric acid solution was then performed at 60° C. for 1 minute followed by desmutting and deoxidizing using an acidic surfactant solution at room temperature for 2 minutes. The aluminum was then zincated using an alkaline ZnO bath at room temperature for 30 seconds. An alkaline electroless nickel plating bath (pH 9.5–10) was used to strike coat the zincated aluminum by immersion in the bath for 5 minutes at 43° C. Water rinses were employed after each of the above steps.

The zincated aluminum specimens were then plated using the above bath. The pH of the bath varied between 7 and 9, and the temperature of the bath was varied between 73° C. and 84° C. Air agitation was used. Specimens were immersed in the bath at the above conditions and the alloy composition varied depending on the operating conditions. The results show that Ni/Co/P alloys containing more than about 20% by weight cobalt and having a % Co/% P weight ratio greater than about 5 provide wear resistant coatings after heat treatment for 1 hour at 200° C. and having a $HV_{10}$ greater than about 650 to about 810. Taber Wear Indexes ranged from about 2.8 to 6.3 using a CS-10 Calibrase wheel under a load of 1 kilogram for 5000 cycles. Alloys having less than 20% by weight cobalt and a % Co/% P ratio below 5 did not have these properties. A prior art commercial wear resistant nickel-Teflon coating exhibited TWI values above 20.

EXAMPLE 2

Electroless Ni—Co—P plating baths were prepared having the following compositions:

| COMPONENT | BATH A | BATH B | BATH C |
|---|---|---|---|
| Nickel sulfate | 22.3 g/L | 15.0 g/L | 26.0 g/L |
| Cobalt sulfate | 14.3 g/L | 15.0 g/L | 17.0 g/L |
| Malic acid | 2.0 g/L | — | — |
| Glycine | 9.3 g/L | — | — |
| Acetic acid | 2.4 g/L | — | — |
| Sodium citrate | 25 g/L | — | 50 g/L |
| Sodium tartrate | — | 99 g/L | — |
| Ammonium sulfate | — | 66 g/L | 40 g/L |
| Sodium glycolate | — | — | 20 g/L |
| Hypophosphite | 35 g/L | 22 g/L | 25 g/L |

All baths had the same stabilizer system (NaSCN and Potassium Iodate), as well as an anionic surfactant.

Aluminum specimens were treated and plated as in Example 1 using Baths A, B and C. The baths had a pH of 8 and an operating temperature of 82° C. All the above baths produced Ni/Co/P deposits containing greater than 20% cobalt and a % Co/% P ratio greater than 5 and all specimens after heat treatment had a $VH_{10}$ greater than 650.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A process for plating a substrate with a nickel, cobalt, phosphorous wear resistant alloy comprising:

providing a substrate having a catalytic surface;

forming a nickel, cobalt, phosphorous coating on the substrate by an electroless plating process using an electroless plating composition comprising:

nickel ions in an amount of about 0.1 to 100 g/l;

cobalt ions in an amount of about 0.1 to 100 g/l;

a phosphorous containing reducing agent in an amount sufficient to reduce the nickel and cobalt ions;

an effective amount of a complexing agent comprising glycolic acid or salts thereof;

an effective amount of buffering agent; and an amount of a pH adjusting material to provide a pH of about 6.5 to 11; with the proviso that the plated alloy contain about 20% to about 70% by weight cobalt, greater than 2% to less than or equal to 9% by weight phosphorous and that the % Co/% P ratio be greater than about 5; and heat treating the plated substrate at a temperature above about 170° C. to increase the hardness and wear resistance of the plated substrate.

2. The process of claim 1 wherein the plated alloy contains about 3% to 5% by weight phosphorous.

3. The process of claim 1 wherein the complexing agent includes glycolic acid or salts thereof in an amount of about 5 to 50 g/l.

4. The process of claim 1 wherein the nickel ions are about 2 to 20 g/l, the cobalt ions are about 2 to 20 g/l and the reducing agent is a hypophosphite in an amount of about 5 to 100 g/l, with the proviso that the plated substrates have a Taber Wear Index less than 20 based on loss in weight in milligrams for 1000 cycles of abrasion when using a CS-10 Calibrase wheel under a load of 1 kilogram for 5000 cycles.

5. The process of claim 1 wherein the plated substrate is heat treated at 170 to 250° C. for 1 to 6 hours.

6. The process of claim 5 wherein the heat treatment is at 170 to 200° C.

7. The process of claim 1 wherein the substrate is aluminum.

8. The process of claim 7 wherein the pH is about 7.5 to 9 and the nickel ions are about 2 to 20 g/l, the cobalt ions are about 2 to 20 g/l and the reducing agent is a hypophosphite in an amount of about 5 to 100 g/l.

9. The process of claim 8 wherein the complexing agent includes glycolic acid or salts thereof in an amount of about 5 to 50 g/l, with the proviso that the plated substrates have a Taber Wear Index less than 20 based on loss in weight in milligrams for 1000 cycles of abrasion when using a CS-10 Calibrase wheel under a load of 1 kilogram for 5000 cycles.

10. The process of claim 9 wherein the plated substrate is heat treated at about 170 to 200° C. for 1 to 6 hours.

11. The process of claim 1 wherein the substrate is zincated aluminum.

12. The process of claim 11 wherein the pH is about 7.5 to 9 and the nickel ions are about 2 to 20 g/l, the cobalt ions are about 2 to 20 g/l and the reducing agent is a hypophosphite in an amount of about 5 to 100 g/l.

13. The process of claim 11 wherein the complexing agent includes glycolic acid or salts thereof in an amount of about 5 to 50 g/l, with the provisio that the plated substrates have a Taber Wear Index less than 20 based on loss in weight in milligrams for 1000 cycles of abrasion when using a CS-10 Calibrase wheel under a load of 1 kilogram for 5000 cycles.

14. The process of claim 13 wherein the plated substrate is heat treated at about 170 to 200° C. for 1 to 6 hours.

* * * * *